6/10/86 OR 4,593,771

United States Patent [19]

Comeau

[11] Patent Number: 4,593,771

[45] Date of Patent: Jun. 10, 1986

[54] TUBING-CONVEYED EXTERNAL GAUGE CARRIERS

[75] Inventor: Laurier J. Comeau, Edmonton, Canada

[73] Assignee: NL Sperry-Sun of Canada, Ltd., Edmonton, Canada

[21] Appl. No.: 582,647

[22] Filed: Feb. 23, 1984

[51] Int. Cl.[4] ..... E21B 47/06; E21B 49/10; E21B 17/16

[52] U.S. Cl. ..... 175/48; 175/320; 166/242

[58] Field of Search ..... 175/325, 40, 48, 308, 175/309, 55, 320; 403/DIG. 8; 73/756, 49.5, 151, 155; 33/1 PT; 166/344, 242, 65, 241, 69, 73, 117.5, 117.6, 113, 250, 66; 29/428; 138/90; 285/106, 105

[56] References Cited

U.S. PATENT DOCUMENTS

| | | | |
|---|---|---|---|
| 3,225,830 | 12/1965 | Livingston | 166/117.5 X |
| 3,965,978 | 6/1976 | Conley et al. | 166/113 |
| 4,105,279 | 8/1978 | Glotin et al. | 166/117.5 X |
| 4,183,243 | 1/1980 | Patterson et al. | 73/155 |
| 4,190,124 | 2/1980 | Terry | 175/325 X |
| 4,428,626 | 1/1984 | Blau et al. | 175/325 X |
| 4,512,402 | 4/1985 | Kompanek et al. | 166/177 X |

FOREIGN PATENT DOCUMENTS

| | | | |
|---|---|---|---|
| 197709 | 9/1977 | U.S.S.R. | 166/65 M |

*Primary Examiner*—Stephen J. Novosad
*Assistant Examiner*—David J. Bagnell
*Attorney, Agent, or Firm*—Carl O. McClenny; William E. Johnson, Jr.

[57] ABSTRACT

An external gauge carrier for use in tubing-conveyed drill stem testing comprises a protective housing for locating and securing the pressure measuring and recording system. The gauge carrier may be manufactured from drill collar bar stock but provides a 1—1 interface with ordinary drill pipe, other measurement subs, perforating guns and the like; i.e., to the complete system it "looks" like a drill collar. The gauge measures and records drill stem bore pressure while providing "full bore" testing capabilities, i.e., the gauge carrier allows unimpeded wireline operation therethrough and causes essentially no pressure drop throughout its length. Special machining and gauge placement is required in order to provide the above capabilities and features while still maintaining sufficient wall thickness to ensure structural integrity. A unique system for protecting the relatively delicate gauges from damage due to shocks from pressure surges is also disclosed.

9 Claims, 11 Drawing Figures

TUBING-CONVEYED EXTERNAL GAUGE CARRIERS

BACKGROUND OF THE INVENTION

1. Field of the Invention

The present invention relates generally to apparatus for carrying pressure gauges used in measuring oil well formation, or bottom hole pressures. More particularly, the invention relates to apparatus for measuring formation pressure and which is adaptable to be tubing conveyed. Even more particularly, the invention relates to formation pressure measurement apparatus which is tubing conveyed but which offers substantially no pressure drop to the fluids flowing therethrough.

2. Description of the Background

Pressure is probably the most important directly measurable parameter of an oil reservoir. From pressure measurements many other important variables can be derived which can be used in evaluating a well or reservoir, such as method of production, effectiveness of secondary recovery processes, etc. Reservoir Engineers can determine effective permeability, porosity, effective drainage radius, extent of well bore damage (if such exists), continuity of aquifer, oil zone or gas cap from various pressure measurements. These provide transient pressure measurements under draw down, or build-up conditions and interference effects in a shut-in well due to a change in production or injection in another well.

Previous pressure measurements have been made with gauges mounted internally to the drill string; i.e. in the drill string bore. However, these have proved unsatisfactory since they created a substantial pressure drop across the measuring sub or prevented flow altogether. These have likewise proved unsatisfactory since, if formation perforation were desired below such gauges, a drop bar system could not be used since the drop bar could not bypass the gauge sub to reach, for example, the firing mechanism of a perforating gun. Mechanical pressure gauges have been mounted on the outside diameter of a measurement sub; however, these have proved unsatisfactory because of their relatively low sensitivity and accuracy and because of their susceptibility to shock and damage resulting from surge pressure due to the firing of the perforating guns.

Many operators now prefer to have a "full bore" string on all their testing for many reasons. The straight-through bore allows the running of wireline tools in and out of the hole, as well as accommodating the use of the drop bar, tubing-conveyed perforating system. Additionally, pressures may be measured in an essentially uncontaminated state since tests, perforating, etc., may be done in an underbalance condition.

In drill stem testing, special formation test equipment is mounted on the end of the drill string and lowered into the hole to a point above or adjacent to the horizon to be tested.

Drill stem tests are made to ascertain the potential productivity of a penetrated zone, to assess formation damage, to determine native reservoir pressures, and to obtain fluid samples (surface and/or subsurface) without cementing casing or removing drilling fluid from the hole. Such tests can also be used to confirm the effectiveness of water shutoffs and to determine the capability of perforations to admit fluids freely to the hole.

A drill stem test involves the measurement of bottom hole pressures with the formation to be tested alternately closed-in and open to flow to the surface. Therefore, the equipment in the overall assembly consists of the pressure-recording device, the flow-control valves, one or more gland-type packers, and various other safety and control mechanisms. Surface equipment may also include pressure and flow measuring and control devices, along with necessary manifolds, tanks, separators, burners, etc. The test equipment or tool is made up on the drill string and set down on the bottom of the hole. A packer, an expandable hard-rubber sealing element, seals off the hole below it by expanding when weight is set down on it. A valve is opened, and any formation pressure and fluids present enter the tool. A recorder in the tool makes a recording of the formation pressure. Then the packer is released and the tool retrieved back to the surface. By looking at the record of the downhole pressure, a good indication of the characteristics of the reservoir can be obtained.

SUMMARY OF THE INVENTION

With the foregoing in view, the present invention provides an externally mounted tubing-conveyed pressure recording system for use in drill stem testing which allows full-bore flow through the entire length of the drill string. This is done by means of an electronic pressure recording system utilizing gauges, having a high degree of accuracy and sensitivity, communicating with the bore of the gauge carrier.

In another feature of the present invention, the gauge carrier provides a direct interface with conventional drill pipe, including the bore therethrough.

In still another feature of the invention, an integral part of the magnetic recording pressure gauge is a transducer protection system which provides protection to the pressure gauge from surge pressures which occur during testing.

In a final feature of the invention, a means is provided for using tubing-conveyed gauge carriers in near-minimum size bore holes while still providing full bore capabilities.

BRIEF DESCRIPTION OF THE DRAWINGS

Other features and intended advantages of the invention will be more readily apparent by the references to the following detailed description in connection with the accompanying drawings wherein.

Figure 1A:
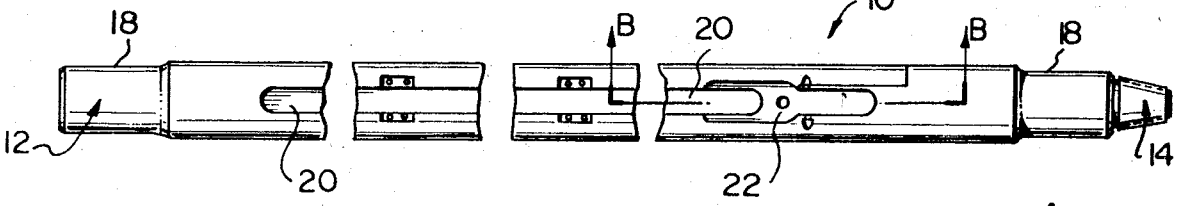
FIG. 1A is a plan view of a gauge carrier having provisions for radially spaced gauges.
Figure 1B:
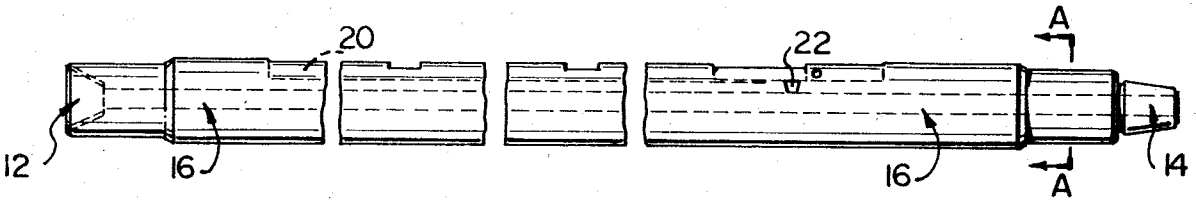
FIG. 1B is a side elevation, partly in section of the gauge carriers of FIG. 1A.
Figure 1C:
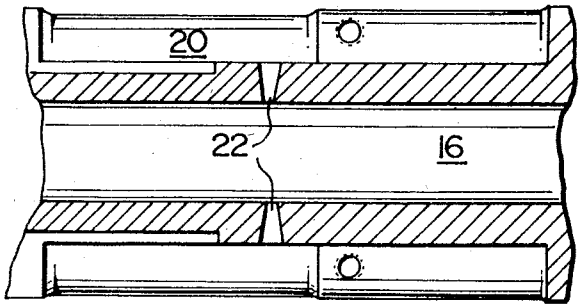
FIG. 1C is a partial sectional view taken on line B—B of FIG. 1A showing provisions for multiple gauges.
Figure 1D:
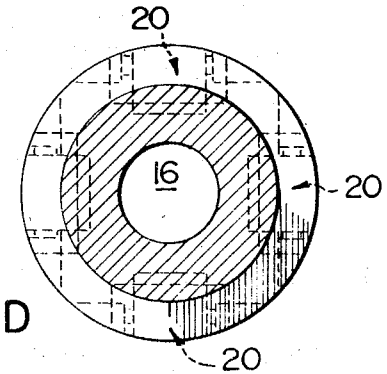
FIG. 1D is a view taken on line A—A of FIG. 1B.

While the invention will be described in connection with the preferred embodiment, it will be understood that it is not intended to limit the invention to that embodiment. On the contrary, it is intended to cover all alternatives, modifications and equivalents as may be included within the spirit of the invention as defined in the appended claims.

DESCRIPTION OF PREFERRED EMBODIMENTS

The purpose of the instant invention is to provide means for positioning a magnetic recording pressure gauge (MRPG) in a bore hole for measuring variables such as temperature and pressure while allowing essentially unimpeded fluid flow through the entire length of the drill string.

The MRPG (not shown) is a conventional system which is battery powered and completely self contained. It produces a permanent record on high temperature magnetic tape. It also contains a crystal controlled clock and a temperature sensor. When power is applied to the gauge, delta time, probe temperature, and pressure are recorded on the tape in digital form. The gauge can be programmed for a non-recording "delay time" of from 0 to 17 hours. The gauge then shifts to a "fast sample" mode (samples every 15 seconds) of from 0 to 7 hours, after which it goes to the standard sample interval. Programming for the delay time, fast sample time and standard sample interval is done at the well site. After retrieval from the well, the magnetic tape is interfaced with a pre-programmed desk top computer and plotter which produces a print-out of delta time, probe temperature and pressure for all recorded samples. Three plots are available (1) Time vs. pressure/-temperature, (2) Blow-ups for enlarging detailed sections, and (3) Horner Feb. 16, 1984 plot. Other data calculations and plot routines are also available. The MRPG is housed in a cylindrically shaped package having a maximum outside diameter of 1.5 inches, a length of approximately 9 feet and weighing approximately 35 pounds.

Referring now to FIGS. 1A through D, a gauge carrier generally designated at 10 is shown. This configuration may be manufactured from a large diameter bar stock (such as is used, for example, for a 15 foot long, 6½ inch O.D. drill collar). The bar stock, in addition to being turned to its 6½ inch O.D., is turned and threaded at the ends thereof to be compatible and interface with a standard 3½ inch I.F. (Internal Flush) drill pipe. Thus, the end 12 is designated as "the box" and the end 14 is designated as "th pin".

The gauge carrier 10 likewise has a bore 16 which interfaces with the bore of a drill pipe, measurement sub, or the like which may be connected thereto, thus providing a continuous bore through the drill string. The ends of the gauge carrier 10 are likewise machined to provide a bottleneck 18 for interfacing with conventional drill pipe tightening tools. Additionally, a groove 20 is milled out of the gauge carrier 10 to provide a protected seat for the MRPG previously described; i.e., the MRPG will not protrude past the protective surface (O.D.) of the gauge carrier 10. The gauge carrier 10 also has a port 22 which permits communication between the gauge carrier bore 16 and the MRPG. This will be described in more detail. Suitable straps or clamps (not shown) are also provided for securing the MRPG in the groove 20. The bore 16 is made by conventional trepanning although extra precaution and continuous monitoring is taken to ensure uniform thickness of the walls of the gauge carrier 10. The gauge carrier 10 may be adapted to accept as many as 4 MRPG's, such as at 90 degree spacing around the circumference. For clarity, only one is shown.

Referring now to FIGS. 2A through D, the gauge carrier 10' is designed for smaller bore holes; i.e., for use at greater depths. This gauge carrier may be machined from bar stock which is suitable for a drill collar 30 feet long having a 7 inch O.D. This gauge carrier likewise has securing clamps (not shown), a box end 12', a pin end 14', bottlenecks 18' and two grooves 20' for receiving two MRPG's. A vent port 22' is also provided in each groove 20' for communication between the bore 16' and the MRPG's.

Figure 2A:
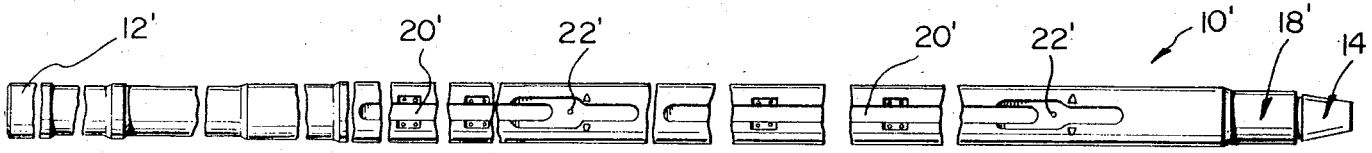
FIG. 2A is a plan view of a gauge carrier having provisions for axially aligned gauges.
Figure 2B:
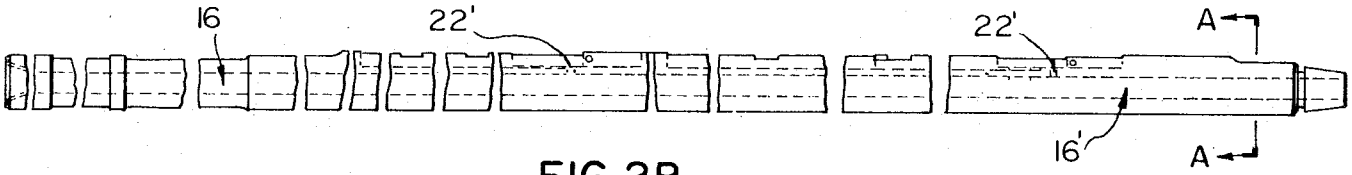
FIG. 2B is a side elevation, partly in section of the gauge carrier of FIG. 2A.
Figure 2C:
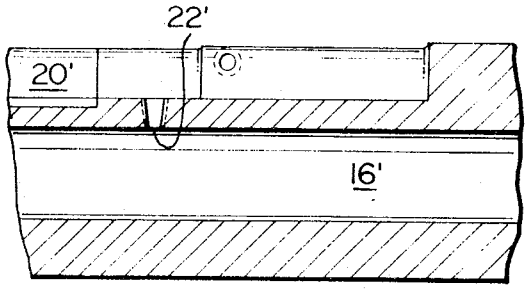
FIG. 2C is a sectional view taken on the ine B—B of FIG. 2A.
Figure 2D:
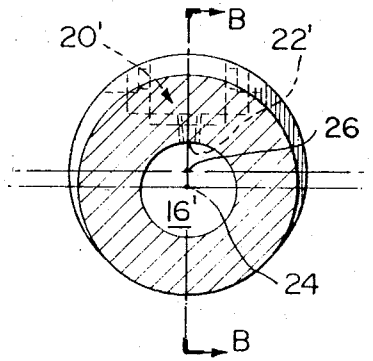
FIG. 2D is an end view taken on line A—A of FIG. 2B.

The gauge carrier 10' must also interface with standard drill pipes, etc. while providing measuring means for minimum diameter bore hole (such as 5.5") and at the same time providing sufficient wall thickness to provide the necessary strength for all operating conditions of the gauge carrier 10'. In order to meet all of those requirements, the gauge carrier 10' requires special machining over and above that required for the gauge carrier 10. In FIG. 2D, an end view of the finished gauge carrier 10' is shown. Remembering that the original bar stock had a 7 inch O.D., the center of the original 7 inch stock is at 24. The conventional bore 16' is made by trepanning with its center at 24. Thus, the center of the bore 16' and the geometric centre of the original 7 inch O.D. stock is at 24. A new center 26 is then selected which will be the geometric center of the completed gauge carrier. The new center 26 is located at a point, measured from a point on the circumference of the original stock, which is preferably at a distance of one-half the desired diameter of the completed gauge carrier. Thus, for a 7" bar stock, the center 26 (for a 5 3/16" gauge carrier having maximum eccentricity) will be approximately 2 19/32" from the circumference of the 7" stock. The original 7" stock is then eccentrically ground about the new center 26 to reduce the diameter of the gauge carrier 10' to approximately 5 3/16 inch; i.e., approximately 1¾ inch of metal is removed from one side of the original 7" bar stock (and essentially none at a point 180° removed therefrom) to produce the 5 3/16 O.D. gauge carrier 10' having a geometric center 26 shown in FIG. 2D. Thus, when completely ground, the gauge carrier 10' is capable of interfacing with standard drill pipe (including the bore thereof) but is of minimum diameter while still maintaining maximum wall thickness. The MRPG's are mounted in grooves 20' milled on the major eccentric side of the gauge carrier 10'.

Figure 3:
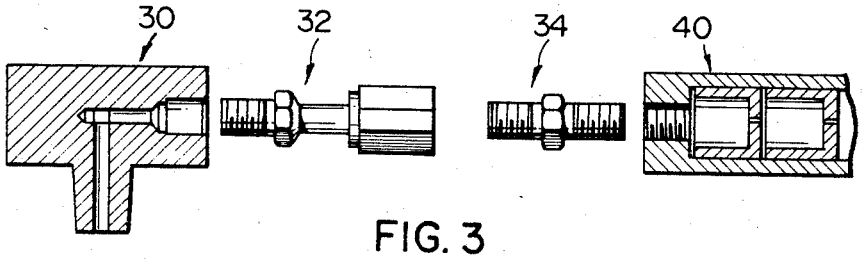
FIG. 3 is a sectional view of the interconnecting mechanisms between the gauge carrier port and the orifice plate assembly.
Figure 4:
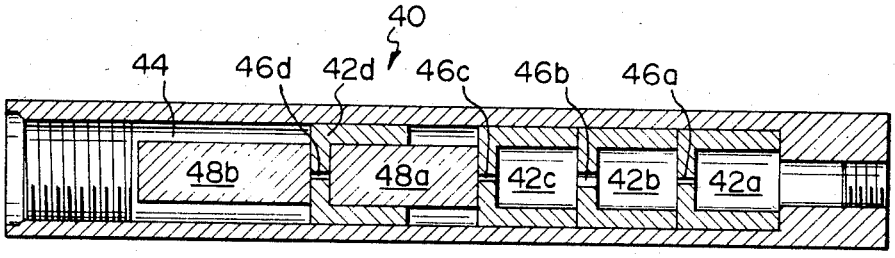
FIG. 4 is a sectional view of the orifice plate assembly.
Figure 5:
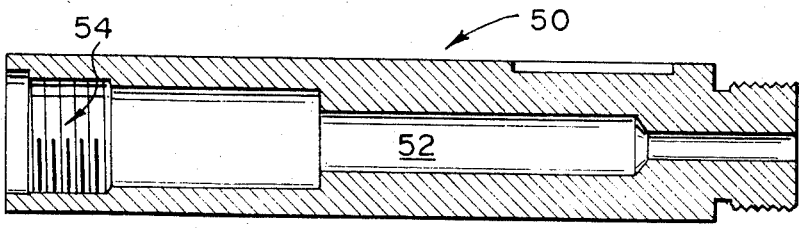
FIG. 5 is a sectional view of the transducer protector.

Referring now to FIGS. 3 through 5, the MRPG's communicate with the gauge carrier bore 16, 16' by means of an elbow fitting 30 which is secured in the port 22, 22'. The outlet of the elbow 30 communicates with a quick connect/disconnect 32 (male-female) which in turn communicates with a male-male quick connect-/disconnect 34 which connects to the orifice plate assembly 40 of FIG. 4. The elbow 30 is protected from mechanical shock and breakage by means of a stop block (not shown).

The orifice plate assembly 40 is essentially a cylinder having multiple orifice plates **42*a–d* in the bore 44 thereof. The orifice plates 42*a–d* are cup-shaped elements having holes 46*a–d* therein, the holes having typical diameters such as 0.050", 0.100", 0.050" and 0.050" respectively. Springs 48*a–b* may be placed between the orifice plates. The orifice plae assembly 40 connects to a transducer protector 50 having an oil-filled bore 52 and a pressure transducer 54** connected in the opposite end thereof.

The purpose of the orifice plate assembly 40 and the transducer protector 50 is to buffer any pressure surges which may enter the port 22,22' and to attenuate such shock waves before they can damage the pressure transducer.

The foregoing description of the invention has been directed in primary part to a particular preferred embodiment in accordance with the "best mode" requirements of the patent statutes and for purposes of explanation and illustration. It will be apparent, however, to those skilled in the art, that many modifications and changes in the described apparatus and method may be made without departing from the scope and spirit of the invention. For example, the specification is directed to a specific pressure-measuring system with integral magnetic recording means, whereas the invention is useful for more general measurement of many different downhole parameters either singly or in combination, with or without recording means. Likewise, a solid-state memory storage means may be used rather than a magnetic recorder. Additionally, drill collars other than those above-described may be employed and may employ instrument housings having dimensions other than those described. Therefore, the invention is not restricted to the particular form of construction and method illustrated and described, but covers all modifications which may fall within the scope of the following claims.

It is the applicant's intention in the following claims to cover such modifications and variations as fall within the true spirit and scope of the invention.

What is claimed is:

1. An apparatus for use in full-bore drill stem testing, comprising:

a pressure measuring and recording system;

carrier means for positioning said pressure measuring and recording system on a drill string in a borehole;

groove means on the exterior of said carrier means for protecting said pressure measuring and recording system;

bore means in said carrier means for providing continuous fluid communication between other components in said drill string and wherein said bore means produce substantially no pressure drop to fluids flowing through said bore;

port means for communicating fluid pressures in said bore to said pressure measuring and recording system; and, transducer means communicating with said port means for detecting fluid pressures present at said port means.

2. The apparatus of claim 1 further comprising, as part of said pressure measuring and recording system, transducer protection means for protecting said transducer means.

3. The apparatus of claim 2 wherein said transducer protection means comprises orifice plates for absorbing fluid shock pressures presented thereto.

4. The apparatus of claim 3 further comprising an oil-filled chamber for communicating fluid pressure to said transducer means while isolating said transducer means from fluids in said bore.

5. The apparatus of claim 1 wherein said carrier means is eccentrically ground.

6. The apparatus of claim 5 wherein the center line of said groove means is located at the maximum distance from said bore means.

7. The apparatus of claim 6 comprising a plurality of said groove means in axial alignment.

8. The apparatus of claim 1 comprising a plurality of said grooves equally spaced around the circumference of said carrier.

9. An apparatus for use in full-bore drill stem testing, comprising:

an instrument for measuring a downhole parameter;

eccentrically ground carrier means for use as a component in a drill string;

bore means in said carrier means for providing continuous fluid communication between the bores of other components in said drill string and wherein said bore means in said carrier means produces substantially no pressure drop to fluids flowing therethrough; and groove means on the exterior of said carrier means for housing and protecting said instrument wherein said groove means is located on the major eccentric side of said carrier means with respect to said bore means.

* * * * *